US011602787B2

(12) United States Patent
Dhaka et al.

(10) Patent No.: US 11,602,787 B2
(45) Date of Patent: Mar. 14, 2023

(54) STEEL LADLE TAPER PLATE ASSEMBLIES

(71) Applicant: United States Steel Corporation, Pittsburgh, PA (US)

(72) Inventors: Rakesh K. Dhaka, Monroeville, PA (US); Mathew T. Mathew, Irondale, AL (US); David J. Radakovic, Elizabeth, PA (US)

(73) Assignee: United States Steel Corporation, Pittsburgh, PA (US)

( * ) Notice: Subject to any disclaimer, the term of this patent is extended or adjusted under 35 U.S.C. 154(b) by 0 days.

(21) Appl. No.: 17/180,828

(22) Filed: Feb. 21, 2021

(65) Prior Publication Data

US 2021/0260648 A1 Aug. 26, 2021

Related U.S. Application Data

(60) Provisional application No. 62/979,901, filed on Feb. 21, 2020.

(51) Int. Cl.
*B22D 41/00* (2006.01)

(52) U.S. Cl.
CPC ..... *B22D 41/00* (2013.01)

(58) Field of Classification Search
None
See application file for complete search history.

(56) References Cited

U.S. PATENT DOCUMENTS

| | | | | |
|---|---|---|---|---|
| 3,679,195 | A * | 7/1972 | Coulter | C21C 5/4646 266/241 |
| 3,894,729 | A * | 7/1975 | Muller | C21C 5/44 266/280 |
| 4,886,247 | A * | 12/1989 | Hoffman | B22D 41/02 266/280 |
| 4,989,843 | A | 2/1991 | Dittrich et al. | |
| 5,118,085 | A * | 6/1992 | Forte | B22D 41/00 266/286 |
| 5,499,798 | A | 3/1996 | Witter et al. | |
| 2021/0260648 | A1 * | 8/2021 | Dhaka | B22D 41/00 |

* cited by examiner

*Primary Examiner* — Scott R Kastler
(74) *Attorney, Agent, or Firm* — Alan G. Towner; Leech Tishman Fuscaldo & Lampl

(57) ABSTRACT

Taper plate assemblies are disclosed that may be installed on the top of steel casting ladles to restrain and maintain refractory lining materials in compression during casting operations. The taper plate assemblies include a generally conical taper plate supported by a ring-shaped support flange and a support collar. The taper plate is located at least partially above a refractory top ring that may comprise a castable refractory material, and is designed to maintain the refractory top ring in compression during multiple casting operations.

53 Claims, 8 Drawing Sheets

STEEL LADLE TAPER PLATE ASSEMBLIES

CROSS-REFERENCE TO RELATED APPLICATION

This application claims the benefit of U.S. Provisional Patent Application No. 62/979,901 filed Feb. 21, 2020, which is incorporated herein by reference.

FIELD OF THE INVENTION

The present invention relates to taper plate assemblies for use in steel production ladles, and more particularly relates to taper plate assemblies that protect and provide compression for refractory linings of the ladles.

BACKGROUND INFORMATION

There are presently various methods of restraining refractory linings in steel ladles by keeping the linings in compression. These include using metal plates and/or metal anchors covered in a refractory castable material and providing metal extension rings at the top of the ladles. However, conventional extension rings deform during use and lose the ability to provide adequate compression to refractory linings over time. As a result, the unconstrained refractory linings can result in loss of refractory bricks during slag dumping or cleaning of ladles, and may allow steel infiltration between joints that can lead to premature removal of ladle from service. The conventional extension rings also require routine maintenance or replacement to address their deformation.

SUMMARY OF THE INVENTION

The present invention provides taper plate assemblies that may be installed on the top of steel casting ladles to restrain and maintain refractory lining materials in compression during casting operations. The taper plate assemblies include a generally conical taper plate supported by a ring-shaped support flange and a support collar. The taper plate is located at least partially above a refractory top ring that may comprise a castable refractory material, and is designed to maintain the refractory top ring in compression during multiple casting operations.

An aspect of the present invention is to provide a taper plate assembly for a steel casting ladle, the assembly comprising: an annular support flange attached to the support collar and extending radially outward from the support collar; and a generally conical taper plate extending upward and radially inward from the support flange at a taper plate angle $A_T$ of greater than 30° measured from a vertical direction.

Another aspect of the present invention is to provide a steel casting ladle comprising: a ladle shell; and a taper plate assembly attached to an upper edge of the ladle shell. The taper plate assembly comprises: an annular support flange attached to the support collar and extending radially outward from the support collar; and a generally conical taper plate extending upward and radially inward from the support flange at a taper plate angle $A_T$ of greater than 30° measured from a vertical direction.

These and other aspects of the present invention will be more apparent from the following description.

BRIEF DESCRIPTION OF THE DRAWINGS

In FIG. 4, the ladle is shown without its refractory lining, and in FIG. 5 the ladle is shown with refractory safety and working linings and a refractory lip ring.

DETAILED DESCRIPTION

Figure 1:
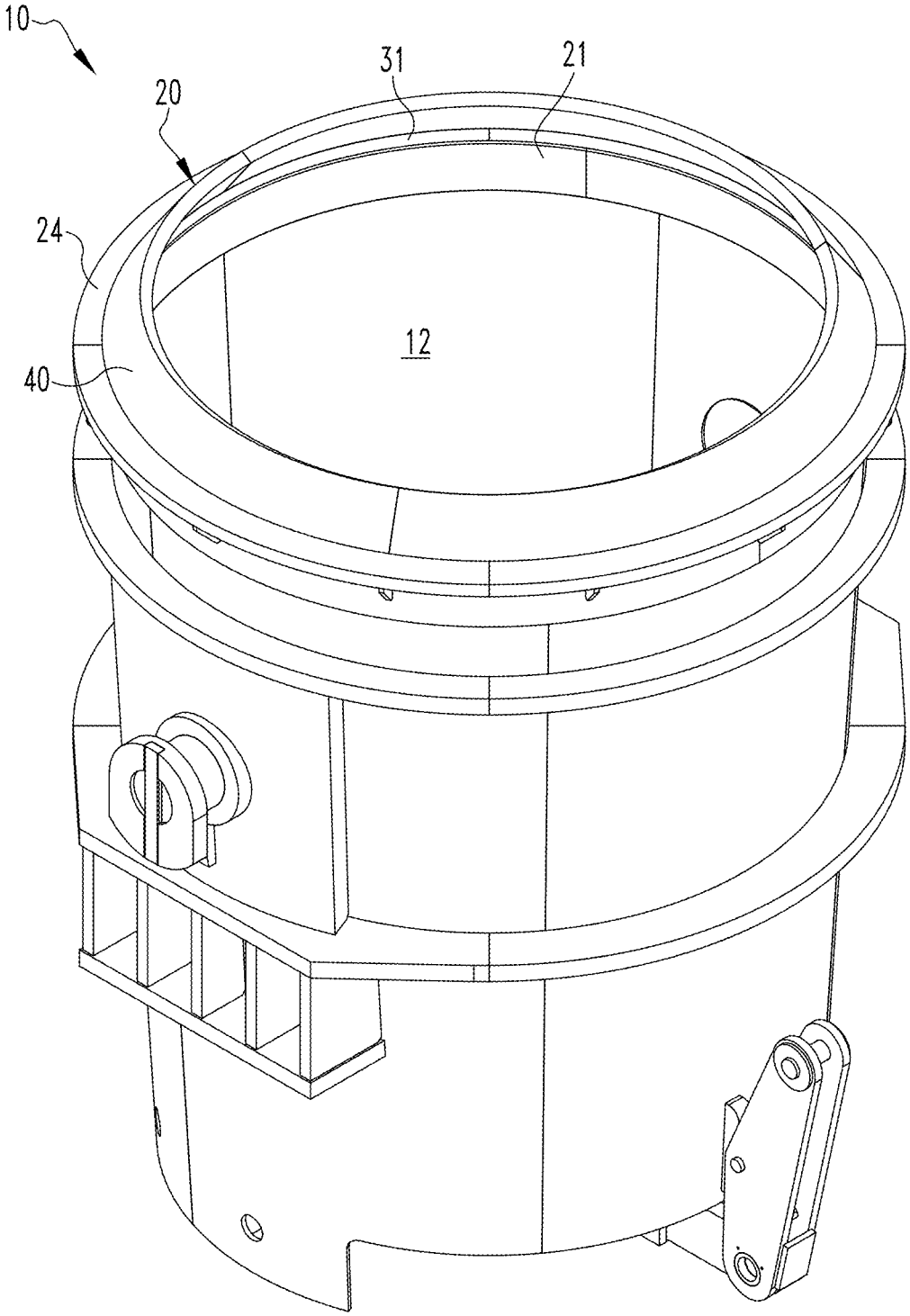
FIG. 1 is an isometric view of a steel casting ladle including a taper plate assembly of the present invention.
Figure 2:
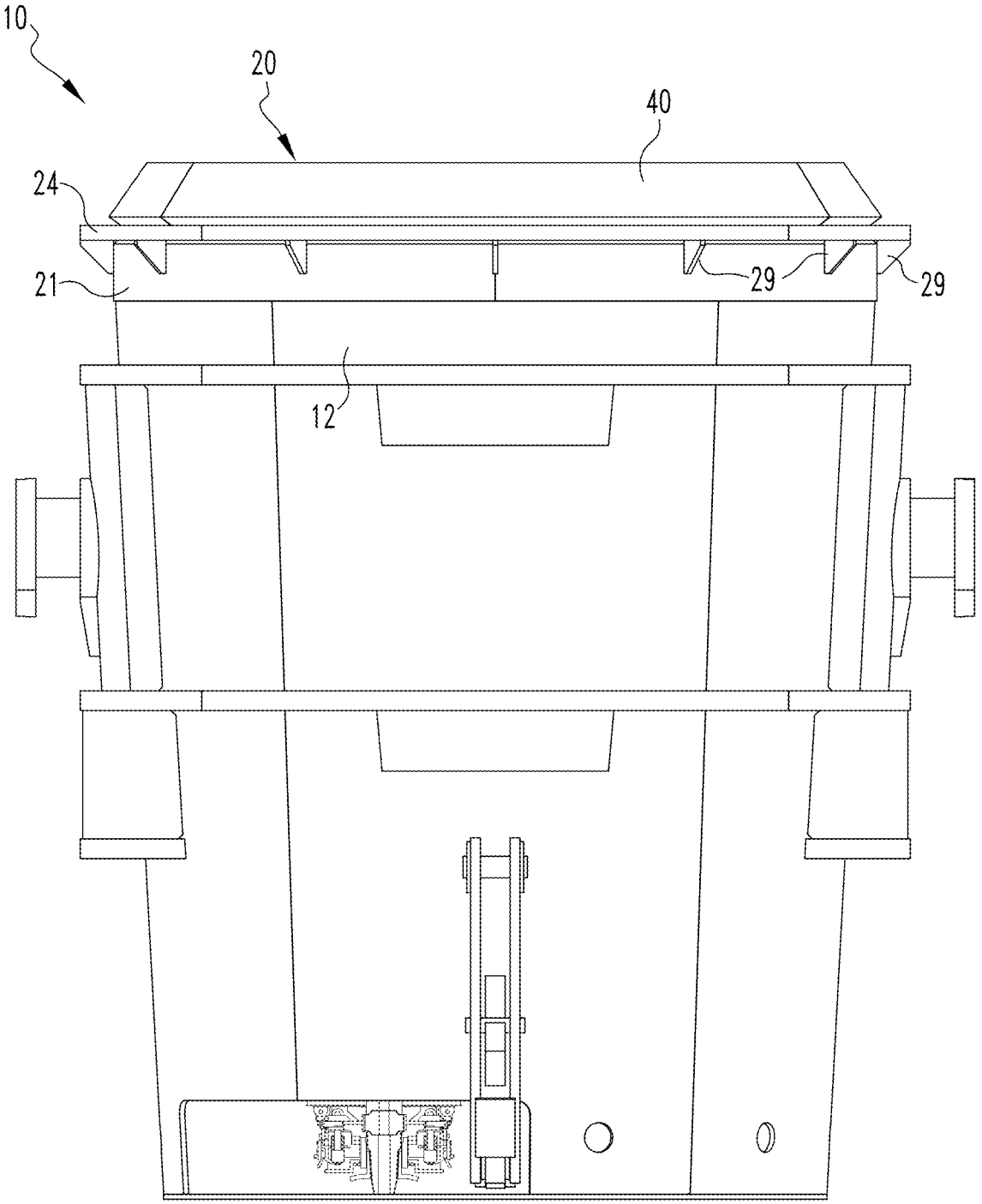
FIG. 2 is a side view and FIG. 3 is a top view of the steel casting ladle and taper plate assembly shown in FIG. 1.
Figure 3:
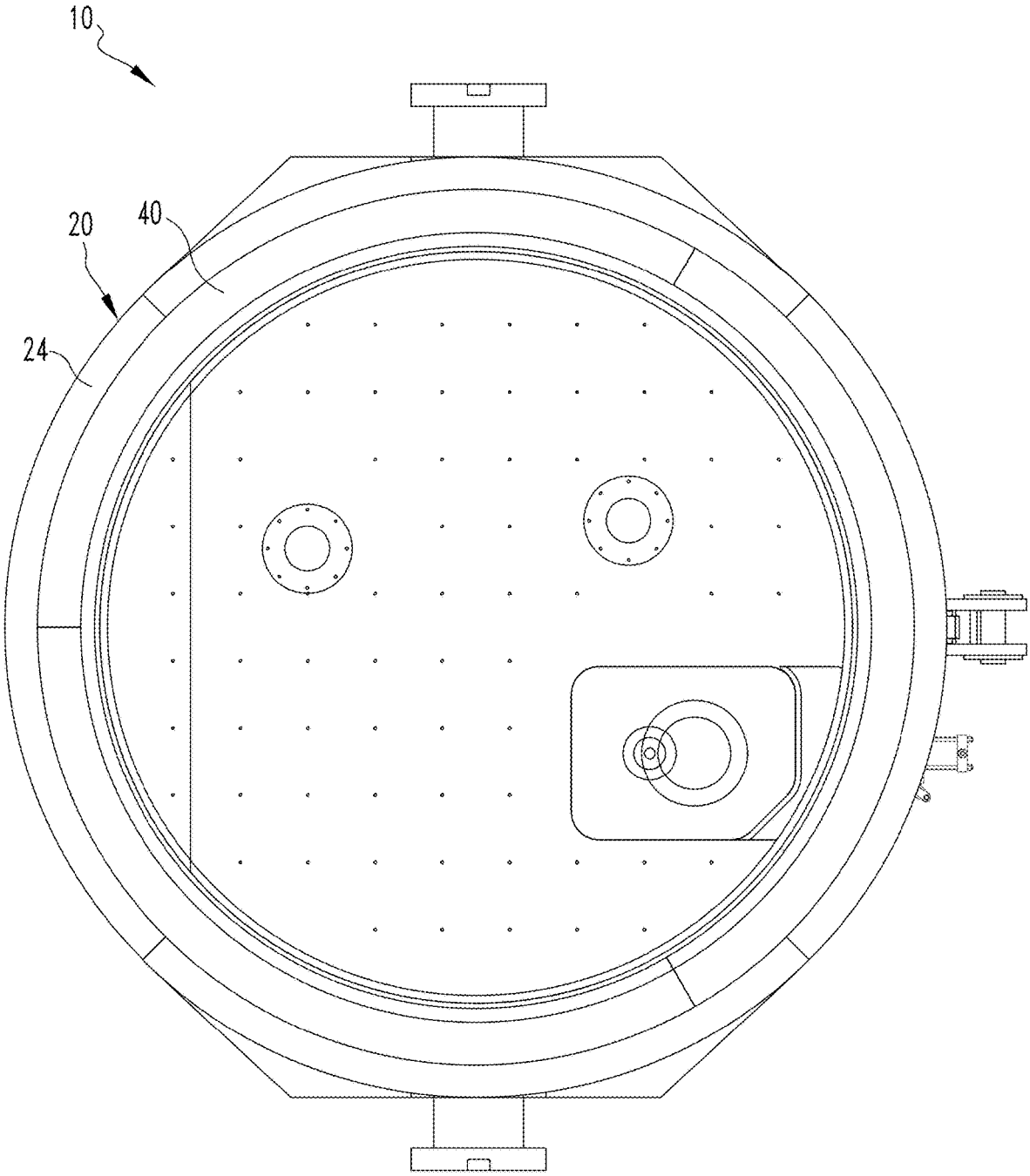

FIGS. 1-3 illustrate a steel casting ladle 10 with a taper plate assembly 20 of the present invention installed on the top of the ladle. The ladle 10 includes a steel shell 12, which may be lined with refractory material, as more fully described below. In the embodiment shown, the taper plate assembly 20 includes a generally cylindrical support collar 21 welded to the upper edge of the ladle shell 12. However, the support collar 21 may not be present in certain embodiments. The taper plate assembly 20 includes a ring-shaped outer support flange 24 welded to an upper edge of the support collar 21 or welded to an upper edge of the ladle shell 12 when a support collar is not used. Alternatively, the outer support flange 24 may be welded to the outer radial surface of the support collar 21 or ladle shell 12. Generally triangular-shaped gussets 29 are welded to the outer surface of the support collar 21 and the underside of the support flange 24 to provide structural support. The taper plate assembly 20 may also include an optional inner support ring 31. A generally conical taper plate 40 attached to the outer support flange 24 is the primary component of the assembly 20 that serves to maintain compression and stability of the ladle sidewall refractory.

Figure 4:
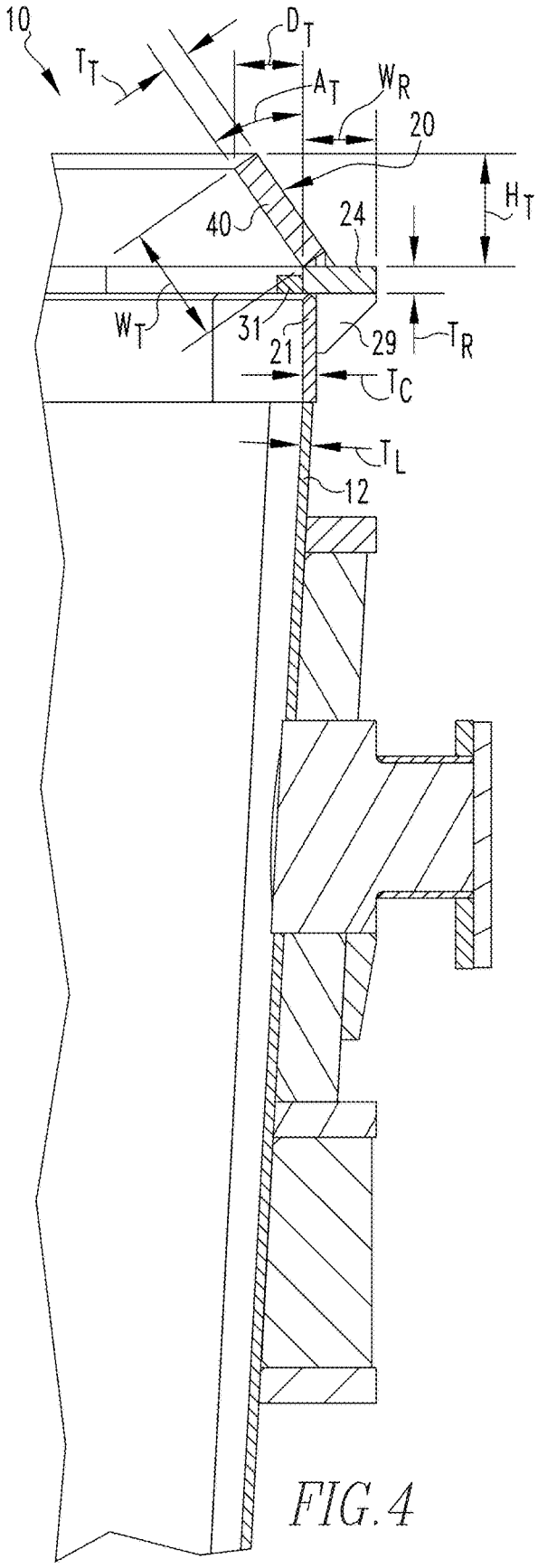
FIGS. 4 and 5 are side sectional views of a portion of a steel casting ladle and taper plate assembly of the present invention.
Figure 5:
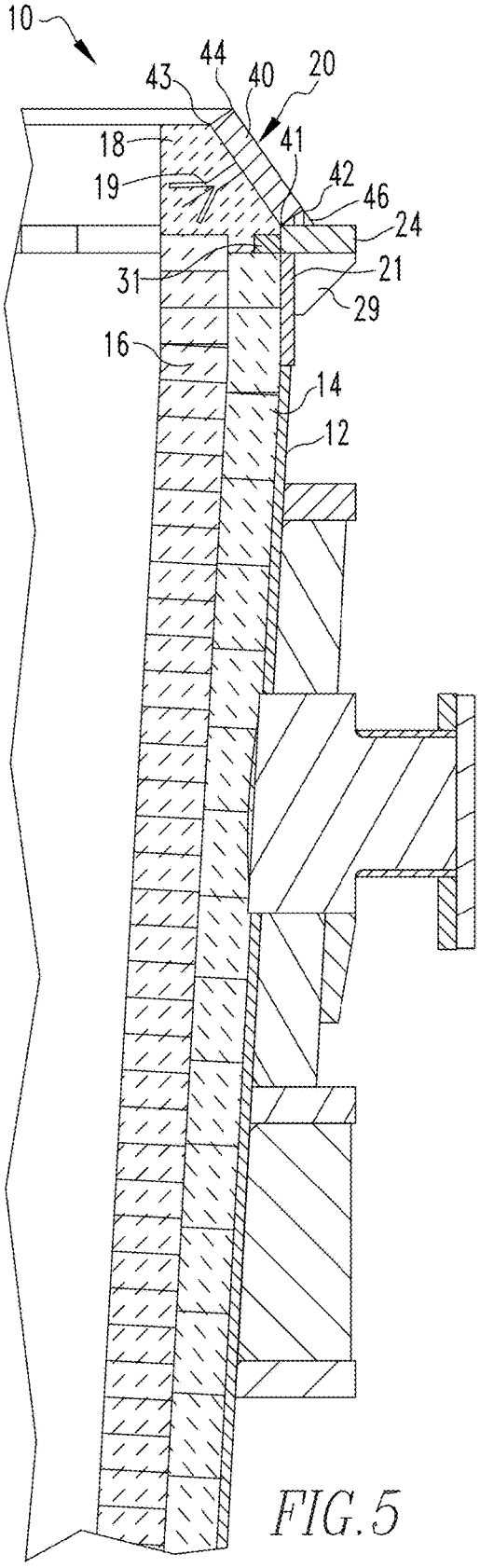
Figure 6:
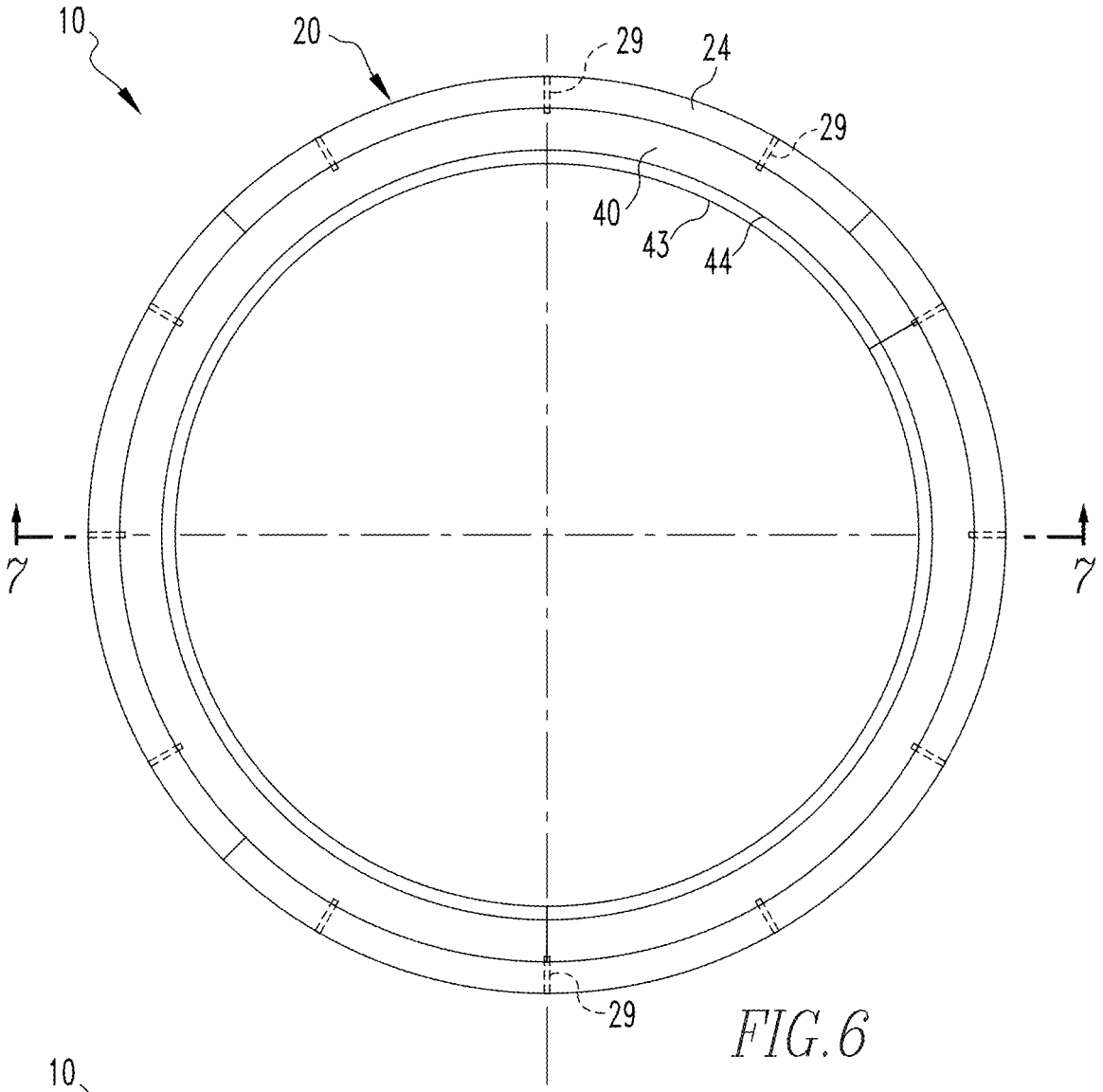
FIG. 6 is a top view of a taper plate assembly of the present invention.

FIGS. 4-7 illustrate additional features of the taper plate assembly 20. In the side sectional views of FIGS. 4 and 5, portions of the ladle 10 and taper plate assembly 20 are shown. In FIG. 4, the ladle shell 12 is shown without a refractory lining. In FIG. 5, the ladle shell 12 is lined with a standard refractory safety lining 14 and a standard refractory working lining 16. The ladle shell 12 has a ladle shell wall thickness TL that may typically be from 0.5 to 1.5 inch, or from 1 to 1.25 inch. The refractory working lining may have a radial thickness of from 4 to 12 inches, or from 6 to 10 inches, or about 8 inches.

As shown in FIGS. 4, 5 and 7-9, the generally cylindrical support collar 21 includes an upper edge 22 that contacts and is welded to the underside of the support flange 24. Although the support collar 21 shown in the figures is generally cylindrical, other shapes such as oblong, elliptical and the like may be used depending on the cross-sectional shape of the top of the ladle shell 12.

Figure 11:
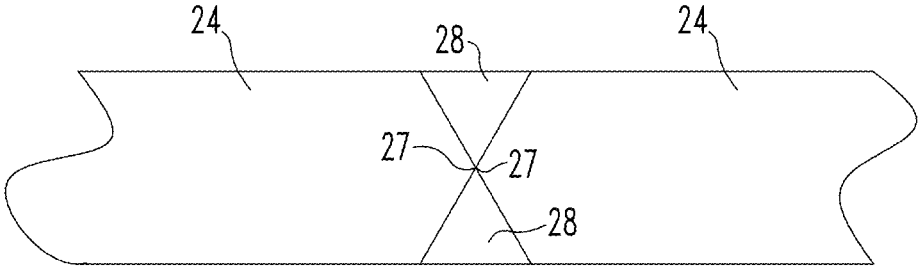
Figure 12:
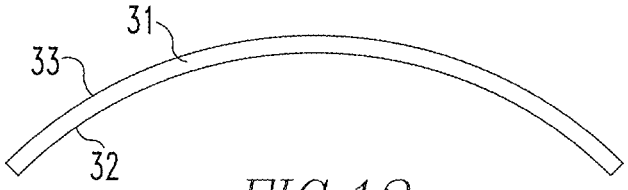
FIG. 12 is a top view of an optional inner support ring of a taper plate assembly in accordance with an embodiment of the present invention.
Figure 13:
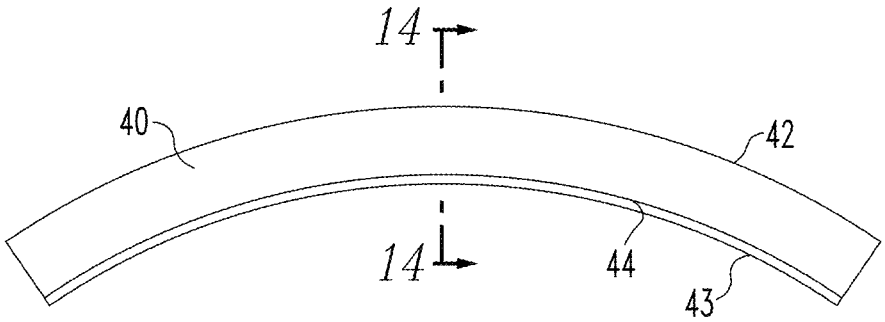
FIG. 13 is a top view of a conical taper plate ring of the present invention.
Figure 14:
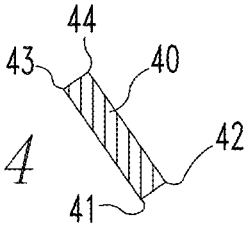
FIG. 14 is a sectional view taken through line 14-14 of FIG. 13.

As shown in FIGS. 4-7, 10 and 11, the support flange 24 includes an inner diameter 25 and an outer diameter 26. In the embodiment shown, the support flange 24 is provided in four arcuate sections, each of which includes section ends 27 that are welded together in a weld zone 28, as shown in FIG. 11. Although the support flange 24 shown in the figures includes four sections that are welded together, any other suitable number of sections or a single continuous ring may be used.

As shown in FIG. 5, a refractory top ring 18 such as a castable or pre-cast refractory material is provided at least partially under the taper plate 40 and above the refractory safety lining 14 and refractory working lining 16. Anchors 19 may optionally be provided for the refractory top ring 18. Each anchor 19 may be generally Y-shaped with a shank made of metal or the like that is welded or otherwise attached to the underside of the taper plate 40, and with metal fingers extending from the shank of the anchor 19 to help keep the refractory top ring 18 such as a castable material in place during installation and operation. Although a single anchor 19 is shown in the cross-sectional view of FIG. 5, multiple anchors may be installed around the circumference of the taper plate 40, for example, from twenty to fifty anchors may be used, or from thirty-five to forty anchors.

As shown in FIGS. 4, 5, 7 and 12, the inner support ring 31 has an inner diameter 32 and an outer diameter 33. The radial width of the inner support ring measured from the inner diameter 32 to the outer diameter 33 may typically range from 1 to 5 inches, for example, from 2 to 4 inches, or about 3 inches. The vertical thickness of the inner support ring 31 may typically range from 0.5 to 3 inches, for example, from 1 to 2 inches, or about 1.5 inch.

Figure 7:
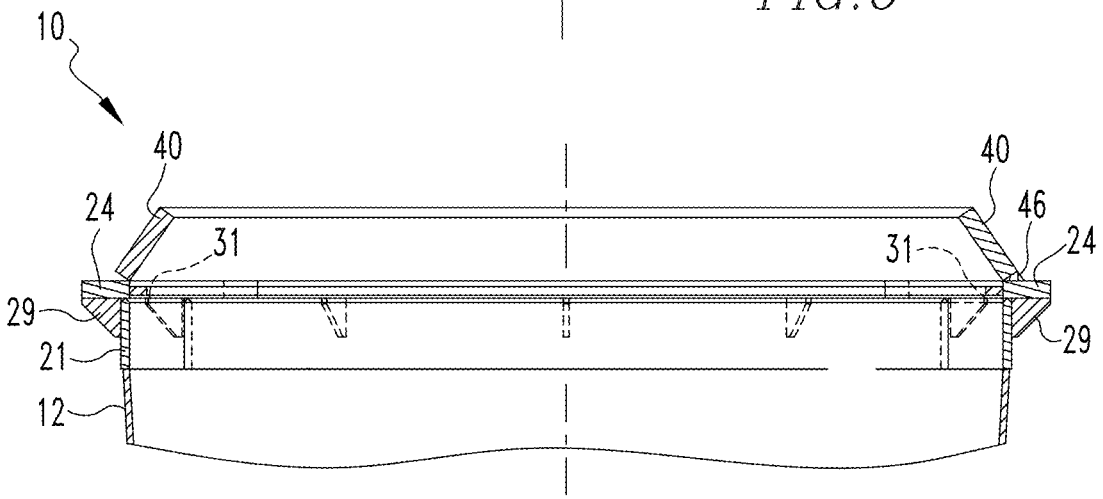
FIG. 7 is a side sectional view taken through section 7-7 of FIG. 6.
Figure 8:
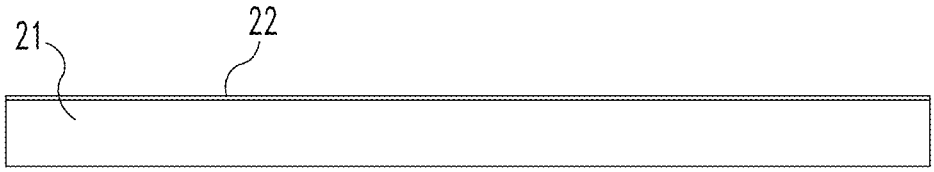
FIG. 8 is a side view and FIG. 9 is a top view of a cylindrical support collar of a taper plate assembly in accordance with an embodiment of the present invention.
Figure 9:
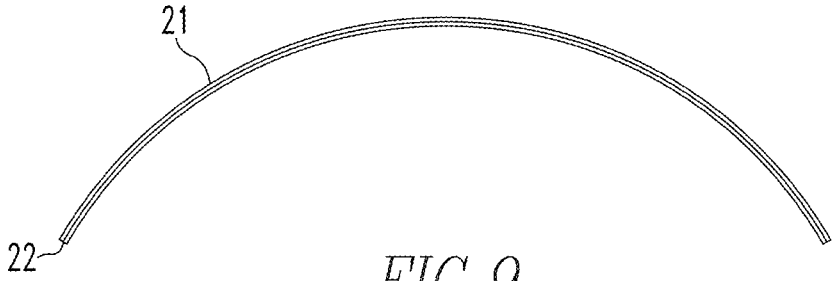
Figure 10:
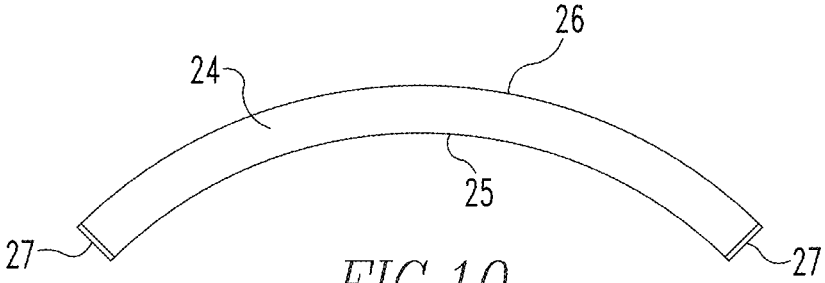
FIG. 10 is a top view and FIG. 11 is a side view of portions of an outer support flange ring of a taper plate assembly of the present invention.

As most clearly shown in FIGS. 5 and 7, the conical taper plate 40 is secured to the upper face of the support flange 24 by a taper plate weld 46. As shown in FIGS. 4-7, 13 and 14, the conical taper plate 40 includes a lower interior edge 41 that may contact the upper face of the support flange 24. The taper plate 40 includes a lower exterior edge 42, and the taper plate weld 46 may be a full penetration weld extending from the lower interior edge 41 to the lower exterior edge 42. The taper plate 40 includes an upper interior edge 43, and an upper exterior edge 44.

As further shown in FIG. 4, the taper plate 40 has a taper plate angle $A_T$ measured from a vertical direction that is typically greater than 30°, for example, greater than 32°, or greater than 34°, or greater than 35°. The taper plate angle $A_T$ may typically range from 32 to 60°, for example, from 34 to 50°, or from 35 to 45°, or about 35°, or about 40°, or about 45°. The taper plate 40 has a taper plate height $H_T$ that is typically greater than 8 inches, for example, greater than 9 inches, or greater than 10 inches. The taper plate height $H_T$ may typically be from 9 to 18 inches, for example, from 10 to 15 inches, or from 10 to 12 inches, or about 11 inches. The taper plate 40 has a taper plate inward radial coverage distance $D_T$ that is typically greater than 4 inches, for example, greater than 5 inches, or greater than 6 inches. The inward radial coverage distance $D_T$ may typically be from 5 to 12 inches, for example, from 6 to 10 inches, or from 7 to 9 inches. The taper plate 40 has a taper plate thickness $T_T$ that is typically greater than 2 inches, for example, greater than 2.5 inches. The taper plate thickness $T_T$ may typically be from 2 to 5 inches, for example, from 2.25 to 4 inches, or from 2.5 to 3.5 inches, or about 3 inches. The taper plate 40 has a taper plate width WT that is typically greater than 10 inches, for example, greater than 12 inches. For example, the taper plate width WT may typically be from 10 to 20 inches, for example, from 12 to 16 inches, or from 13 to 14 inches.

The radially inwardly extending coverage distance $D_T$ of the taper plate 40 may be sufficient to cover at least a portion of the refractory working lining 16, i.e., at least a portion of the radial thickness of the refractory working lining 16 is located vertically below the taper plate 40. For example, the coverage distance $D_T$ of the taper plate 40 is sufficient to cover at least 10 percent of the radial thickness of the underlying refractory working lining 16 as measured at the upper edge of the working lining, or at least 15 percent, or at least 20 percent, or at least 25 percent. The coverage distance $D_T$ may be sufficient to cover from 20 to 100 percent of the radial thickness of the refractory working lining 16, or from 20 to 75 percent, or from 20 to 50 percent, or from 25 to 75 percent.

As further shown in FIG. 4, the optional support collar 21 has a wall thickness $T_C$ that is typically greater than 1 inch, for example, greater than 1.25 inch. The support collar wall thickness $T_C$ may typically be from 1 to 3 inches, for example, from 1.25 to 2 inches, or about 1.5 inch. When a support collar is not used, the wall thickness TL of the ladle shell at its upper edge may be at least 0.5 inch, for example, from 0.75 to 1.5 inch, or from 1 to 1.25 inch.

The taper plate thickness $T_T$ is typically greater than the support collar wall thickness $T_C$. For example, the ratio of $T_T$:$T_C$ is typically greater than 1.2:1, or greater than 1.4:1, or greater than 1.5:1. The ratio of $T_T$:$T_C$ may typically range from 1.3:1 to 5:1, or from 1.4:1 to 4:1, or from 1.5:1 to 3:1. In certain embodiments, the ratio of $T_T$:$T_C$ may be about 1.75:1, or about 2:1, or about 2.25:1.

The support flange 24 has a thickness $T_R$ typically greater than 2 inches, for example, greater than 2.5 inches. The support flange thickness $T_R$ may typically be from 2 to 5 inches, for example, from 2.25 to 4 inches, or from 2.5 to 3.5 inches, or about 3 inches. The support flange 24 has a width $W_R$ typically greater than 4 inches, for example, greater than 6 inches, or greater than 7 inches, or greater than 8 inches. The support flange ring width $W_R$ may typically be from 5 to 12 inches, for example, from 6 to 10 inches, or from 7 to 9 inches.

The support flange thickness $T_R$ is typically greater than the support collar wall thickness $T_C$. For example, the ratio of $T_R$:$T_C$ is typically greater than 1.2:1, or greater than 1.4:1, or greater than 1.5:1. The ratio of $T_R$:$T_C$ may typically range from 1.3:1 to 5:1, or from 1.4:1 to 4:1, or from 1.5:1 to 3:1. In certain embodiments, the ratio of $T_R$:$T_C$ may be about 1.75:1, or about 2:1, or about 2.25:1.

The taper plate thickness Ti may be the same or different than the support flange thickness $T_R$. For example, the ratio of $T_T$:$T_R$ may range from 0.5:1 to 2:1, or from 0.7:1 to 1.5:1, or from 0.8:1 to 1.3:1, or may be about 1:1.

Table 1 lists various angles and height of tapers and their corresponding coverage over the refractory lining. The taper plate angles $A_T$ range from 30° to 45°, and different taper plate heights and inward radial coverage distances or projection lengths are shown, in inches. The taper plates with 35° and 45° taper angles provide significantly improved compression to the underlying refractory top ring 18 and refractory linings 14 and 16 during extended use, and are significantly more durable than the taper plates with 30° taper angles having smaller vertical heights and horizontal projections.

TABLE 1

| Taper Top Angle and Height | | | |
|---|---|---|---|
| | Taper Plate Angle | | |
| | 30° | 35° | 45° |
| Vertical Height | 8.63 | 8.63 | 8.63 |
| Horizontal Projection | 4.98 | 6.04 | 8.63 |
| Vertical Height | 10.00 | 10.00 | 10.00 |
| Horizontal Projection | 5.77 | 7.00 | 10.00 |
| Vertical Height | 11.00 | 11.00 | 11.00 |
| Horizontal Projection | 6.35 | 7.70 | 11.00 |

By extending the taper plate height $H_T$ to, e.g., 10 or 11 inches and providing a taper angle $A_T$ of about 35° or 45°, the stress originating not only from the refractory safety lining 14 but also at least a portion of the stress and vertical expansion of the refractory working lining 16 will be covered. Compressive stress is increased in the refractory top ring 18 installed above the brick lining 14 and 16. The compressive strength of refractory top ring 18 is high enough that the increased stress will not have a negative impact on the performance of the refractory top ring 18.

At 11 inches and a 35-degree angle, the horizontal coverage is 7.77 inches, thus covering the entire safety lining 14 (e.g., 5.5 inches) and 2.2 inches of the working lining 16 (e.g., out of an 8 inch thick working lining). Changing the taper plate angle $A_T$ from 30° to 35° and increasing the vertical length of the taper plate from 8.6 inches to 11 inches thus significantly improves performance of the taper plate assembly. The combined effect of changing the vertical height $H_T$ of the taper plate 40 and the taper plate angle $A_T$ is such that the horizontal coverage distance $D_T$ is at least 20 percent of the working lining 16 thickness for effective compression.

Figure 15:
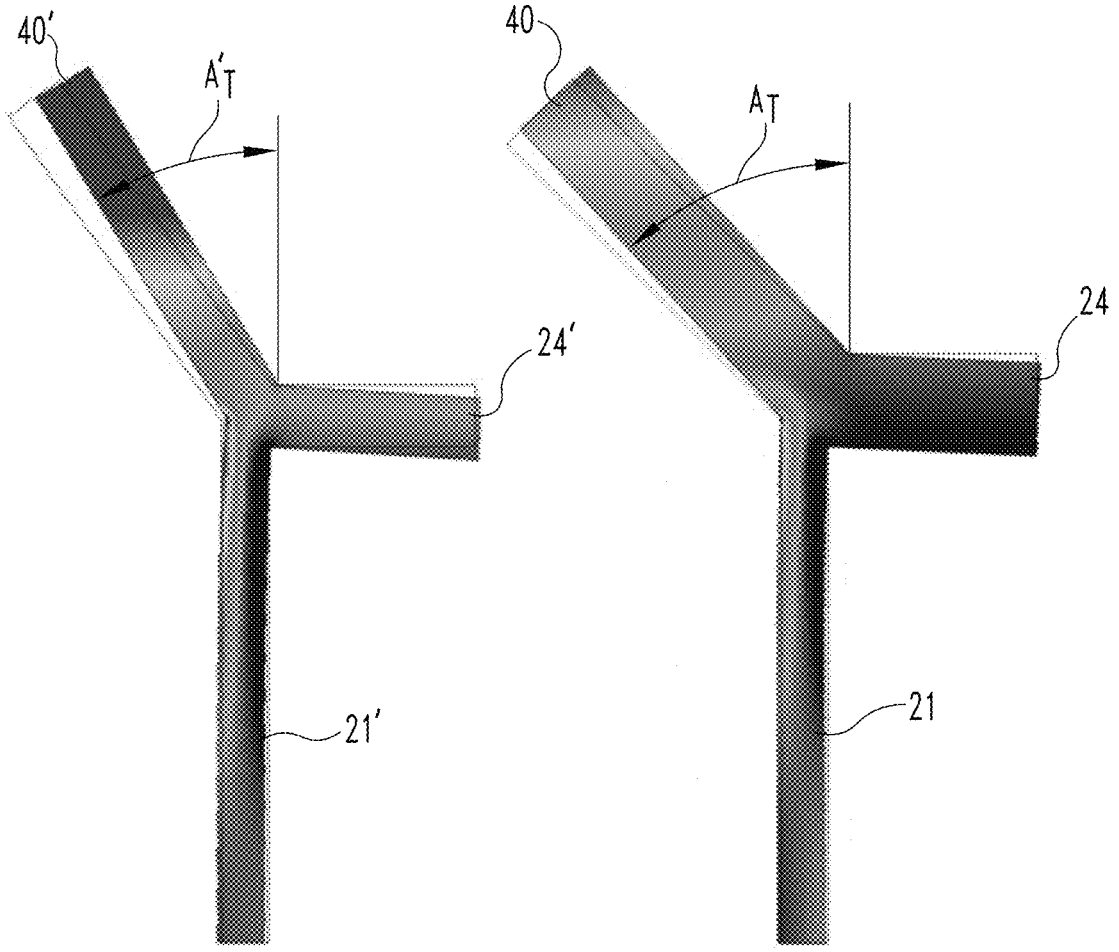
FIG. 15 includes cross-sectional images of a comparative taper plate assembly and a taper plate assembly of the present invention illustrating reduced stress concentrations and improved structural integrity of the taper plate assembly of the invention.

FIG. 15 includes cross-sectional computational modeling images of a comparative taper plate assembly on the left and a taper plate assembly of the present invention on the right, illustrating reduced stress concentrations and improved structural integrity of the taper plate assembly of the invention. The images shown in FIG. 15 were generated by commercially available software under the designation ABAQUS from Dassault Systemes Simulia Corporation. As can be seen by comparing the taper plate assembly of the present invention including the taper plate 40, support collar 21 and support flange 24 against the comparative taper plate assembly including a cylindrical support collar 21', comparative outer support flange 24' and comparative taper plate 40', the thicker support flange 24, thicker taper plate 40 and greater taper plate angle $A_T$ resist deformation and reduce stress concentrations. As a result, the taper plate 40 is capable of maintaining sufficient compression on the underlying refractory castable 18 during extended usage.

The taper plate assemblies of the present invention provide improved compression for refractory linings, which help achieve longer campaign life and thus reduce cost. Additionally, the present taper plate assemblies address the common issue in the steel mill of losing compression in the lining due to deformation of the top over time. The present taper plate assemblies last significantly longer, and may not need any repairs of the top section of ladle. In contrast, conventional ladle designs require replacement of the top sections of ladles after a certain number of years to maintain the same level of compression. The taper plate assemblies address the issue of lip ring-related failures and repair common in the steel mills. The assemblies can help lower costs of steel ladle refractories by improving performance, keeping linings in compression and reducing costs for steel ladle shell repair work.

As used herein, "including," "containing" and like terms are understood in the context of this application to be synonymous with "comprising" and are therefore open-ended and do not exclude the presence of additional undescribed or unrecited elements, materials, phases or method steps. As used herein, "consisting of" is understood in the context of this application to exclude the presence of any unspecified element, material, phase or method step. As used herein, "consisting essentially of" is understood in the context of this application to include the specified elements, materials, phases, or method steps, where applicable, and to also include any unspecified elements, materials, phases, or method steps that do not materially affect the basic or novel characteristics of the invention.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard variation found in their respective testing measurements.

Also, it should be understood that any numerical range recited herein is intended to include all sub-ranges subsumed therein. For example, a range of "1 to 10" is intended to include all sub-ranges between (and including) the recited minimum value of 1 and the recited maximum value of 10, that is, having a minimum value equal to or greater than 1 and a maximum value of equal to or less than 10.

In this application, the use of the singular includes the plural and plural encompasses singular, unless specifically stated otherwise. In addition, in this application, the use of "or" means "and/or" unless specifically stated otherwise, even though "and/or" may be explicitly used in certain instances. In this application and the appended claims, the articles "a," "an," and "the" include plural referents unless expressly and unequivocally limited to one referent.

Whereas particular embodiments of this invention have been described above for purposes of illustration, it will be evident to those skilled in the art that numerous variations of the details of the present invention may be made without departing from the invention as defined in the appended claims.

What is claimed is:

1. A taper plate assembly for a steel casting ladle, the assembly comprising:

an annular support flange attached to a support collar and extending radially outward from the support collar; and a generally conical taper plate extending upward and radially inward from the support flange at a taper plate angle $A_T$ of greater than 30° measured from a vertical direction and the taper plate extends radially inward abutting a surface of a top refractory lining a coverage distance $D_T$ to cover a refractory safety lining and at least 10 percent of a radial thickness of a refractory working lining such that the taper plate applies and maintains a compressive force on the top refractory ring, the refractory working lining and the refractory safety lining to resist deformation during use.

2. The taper plate assembly of claim 1, wherein the taper plate angle $A_T$ is from 32 to 60°.

3. The taper plate assembly of claim 1, wherein the taper plate angle $A_T$ is from 34 to 50°.

4. The taper plate assembly of claim 1, wherein the taper plate angle $A_T$ is from 35 to 45°.

5. The taper plate assembly of claim 1, wherein the taper plate has a taper plate height $H_T$ of greater than 8 inches, and a taper plate inward radial coverage distance $D_T$ of greater than 5 inches.

6. The taper plate assembly of claim 5, wherein the taper plate height $H_T$ is from 10 to 15 inches, and the taper plate inward radial coverage distance $D_T$ is from 6 to 10 inches.

7. The taper plate assembly of claim 1, wherein the taper plate has a taper plate thickness $T_T$ of greater than 2 inches, and a taper plate width $W_T$ of greater than 10 inches.

8. The taper plate assembly of claim 7, wherein the taper plate thickness $T_T$ is from 2.5 to 3.5 inches, and the taper plate width $W_T$ is from 12 to 16 inches.

9. The taper plate assembly of claim 1, wherein the support flange has a support flange thickness $T_R$ of greater than 2 inches, and a support flange width $W_R$ of greater than 4 inches.

10. The taper plate assembly of claim 9, wherein the support flange thickness $T_R$ is from 2.5 to 3.5 inches, and the support flange width $W_R$ is from 6 to 10 inches.

11. The taper plate assembly of claim 1, wherein the support collar has a support collar wall thickness $T_C$ of from 1 to 2 inches.

12. The taper plate assembly of claim 11, wherein the taper plate has a taper plate thickness $T_T$ greater than the support collar wall thickness $T_C$.

13. The taper plate assembly of claim 12, wherein a ratio of $T_T$:$T_C$ is greater than 1.2:1.

14. The taper plate assembly of claim 13, wherein the ratio of $T_T$:$T_C$ is from 1.5:1 to 4:1.

15. The taper plate assembly of claim 13, wherein the ratio of $T_T$:$T_C$ is about 2:1.

16. The taper plate assembly of claim 11, wherein the support flange has a support flange thickness $T_R$ greater than the support collar wall thickness $T_C$.

17. The taper plate assembly of claim 16, wherein a ratio of $T_R$:$T_C$ is greater than 1.2.1.

18. The taper plate assembly of claim 17, wherein the ratio of $T_R$:$T_C$ is from 1.5:1 to 4:1.

19. The taper plate assembly of claim 17, wherein the ratio of $T_R$:$T_C$ is about 2:1.

20. The taper plate assembly of claim 1, wherein the taper plate has a taper plate thickness $T_T$, the support flange has a support flange thickness $T_R$, and a ratio of $T_T$:$T_R$ is from 0.7:1 to 1.5:1.

21. The taper plate assembly of claim 20, wherein the ratio of $T_T$:$T_R$ is about 1:1.

22. The taper plate assembly of claim 1, further comprising an inner support ring extending radially inward from the support flange and located vertically below the taper plate.

23. The taper plate assembly of claim 22, wherein the inner support ring has a horizontal width of from 2 to 4 inches and a vertical thickness of from 1 to 2 inches.

24. The taper plate assembly of claim 1, wherein the coverage distance $D_T$ of the taper plate is sufficient to cover at least 20 percent of the radial thickness of the refractory working lining.

25. The taper plate assembly of claim 1, wherein the coverage distance $D_T$ of the taper plate is sufficient to cover from 25 to 75 percent of the radial thickness of the refractory working lining.

26. A steel casting ladle comprising:

a ladle shell; and a taper plate assembly attached to an upper edge of the ladle shell, wherein the taper plate assembly comprises:

an annular support flange attached to a support collar and extending radially outward from the support collar; and a generally conical taper plate extending upward and radially inward from the support flange at a taper plate angle $A_T$ of greater than 30° measured from a vertical direction;

a refractory safety lining against an interior surface of the ladle shell;

a refractory working lining against an interior surface of the safety lining; and a refractory top ring vertically above the refractory safety lining and the refractory working lining, and the taper plate extends radially inward abutting a surface of the top refractory lining a coverage distance $D_T$ to cover the refractory safety lining and at least 10 percent of a radial thickness of the refractory working lining such that the taper plate applies and maintains a compressive force on the top refractory ring, the refractory working lining and the refractory safety lining to resist deformation during use.

27. The steel casting ladle of claim 26, wherein the coverage distance $D_T$ of the taper plate is sufficient to cover at least 20 percent of the radial thickness of the refractory working lining.

28. The steel casting ladle of claim 26, wherein the coverage distance $D_T$ of the taper plate is sufficient to cover from 25 to 75 percent of the radial thickness of the refractory working lining.

29. A taper plate assembly for a steel casting ladle, the assembly comprising:

an annular support flange attached to a support collar and extending radially outward from the support collar;

a generally conical taper plate extending upward and radially inward from the support flange at a taper plate angle $A_T$ of greater than 30° measured from a vertical direction; and an inner support ring extending radially inward from the support flange and located vertically below the taper plate. The taper plate assembly of claim 1, wherein the taper plate angle $A_T$ is from 32 to 60°.

30. The taper plate assembly of claim 29, wherein the taper plate angle $A_T$ is from 34 to 50°.

31. The taper plate assembly of claim 29, wherein the taper plate angle $A_T$ is from 35 to 45°.

32. The taper plate assembly of claim 29, wherein the taper plate has a taper plate height $H_T$ of greater than 8 inches, and a taper plate inward radial coverage distance $D_T$ of greater than 5 inches.

33. The taper plate assembly of claim 32, wherein the taper plate height $H_T$ is from 10 to 15 inches, and the taper plate inward radial coverage distance $D_T$ is from 6 to 10 inches.

34. The taper plate assembly of claim 29, wherein the taper plate has a taper plate thickness $T_T$ of greater than 2 inches, and a taper plate width $W_T$ of greater than 10 inches.

35. The taper plate assembly of claim 34, wherein the taper plate thickness $T_T$ is from 2.5 to 3.5 inches, and the taper plate width $W_T$ is from 12 to 16 inches.

36. The taper plate assembly of claim 29, wherein the support flange has a support flange thickness $T_R$ of greater than 2 inches, and a support flange width $W_R$ of greater than 4 inches.

37. The taper plate assembly of claim 36, wherein the support flange thickness $T_R$ is from 2.5 to 3.5 inches, and the support flange width $W_R$ is from 6 to 10 inches.

38. The taper plate assembly of claim 29, wherein the support collar has a support collar wall thickness $T_C$ of from 1 to 2 inches.

39. The taper plate assembly of claim 38, wherein the taper plate has a taper plate thickness $T_T$ greater than the support collar wall thickness $T_C$.

40. The taper plate assembly of claim 39, wherein a ratio of $T_T$:$T_C$ is greater than 1.2:1.

41. The taper plate assembly of claim 40, wherein the ratio of $T_T$:$T_C$ is from 1.5:1 to 4:1.

42. The taper plate assembly of claim 40, wherein the ratio of $T_T$:$T_C$ is about 2:1.

43. The taper plate assembly of claim 38, wherein the support flange has a support flange thickness $T_R$ greater than the support collar wall thickness $T_C$.

44. The taper plate assembly of claim 43, wherein a ratio of $T_R$:$T_C$ is greater than 1.2:1.

45. The taper plate assembly of claim 44, wherein the ratio of $T_R$:$T_C$ is from 1.5:1 to 4:1.

46. The taper plate assembly of claim 44, wherein the ratio of $T_R$:$T_C$ is about 2:1.

47. The taper plate assembly of claim 29, wherein the taper plate has a taper plate thickness $T_T$, the support flange has a support flange thickness $T_R$, and a ratio of $T_T$:$T_R$ is from 0.7:1 to 1.5:1.

48. The taper plate assembly of claim 47, wherein the ratio of $T_T$:$T_R$ is about 1:1.

49. The taper plate assembly of claim 29, wherein the inner support ring has a horizontal width of from 2 to 4 inches and a vertical thickness of from 1 to 2 inches.

50. The taper plate assembly of claim 29, further comprising a refractory top ring located at least partially vertically below the taper plate, and a refractory working lining located at least partially vertically below the taper plate.

51. The taper plate assembly of claim 50, wherein the taper plate extends radially inward a coverage distance $D_T$ sufficient to cover at least 10 percent of a radial thickness of the refractory working lining.

52. The taper plate assembly of claim 51, wherein the coverage distance $D_T$ of the taper plate is sufficient to cover at least 20 percent of the radial thickness of the refractory working lining.

53. The taper plate assembly of claim 51, wherein the coverage distance $D_T$ of the taper plate is sufficient to cover from 25 to 75 percent of the radial thickness of the refractory working lining.

* * * * *